US011348559B1

(12) United States Patent
Li

(10) Patent No.: US 11,348,559 B1
(45) Date of Patent: May 31, 2022

(54) MUSIC BOX STRUCTURE WITH COMPOSING FUNCTION

(71) Applicant: Ken-Ming Li, Zhubei (TW)

(72) Inventor: Ken-Ming Li, Zhubei (TW)

( * ) Notice: Subject to any disclaimer, the term of this patent is extended or adjusted under 35 U.S.C. 154(b) by 0 days.

(21) Appl. No.: 17/227,288

(22) Filed: Apr. 10, 2021

(51) Int. Cl.
*G10F 1/06* (2006.01)

(52) U.S. Cl.
CPC ..... *G10F 1/06* (2013.01)

(58) Field of Classification Search
CPC ..... B10F 1/06
See application file for complete search history.

(56) References Cited

U.S. PATENT DOCUMENTS 1,969,147 A * 8/1934 Paul ..... G10F 1/06 984/204
2,557,061 A * 6/1951 Goldman ..... G10F 1/06 84/94.1
2,812,680 A * 11/1957 Fedoryszyn ..... G10F 1/06 84/404
4,144,791 A * 3/1979 Veach ..... G10F 5/04 84/96
6,723,911 B2 * 4/2004 Muramatsu ..... G10H 1/32 84/402
7,321,090 B2 * 1/2008 Meng-Suen ..... G10F 1/06 84/94.1
7,544,870 B2 * 6/2009 White ..... G10F 1/06 84/94.1
8,847,049 B2 * 9/2014 Han ..... G10F 1/06 84/115
8,962,955 B2 * 2/2015 Ikeda ..... G04B 23/005 84/97
9,047,854 B1 * 6/2015 Kosmer ..... G10H 1/32
9,257,108 B2 * 2/2016 Nakamura ..... G10F 1/06
9,396,713 B2 * 7/2016 Ikeda ..... G10F 1/06
2004/0065184 A1 * 4/2004 Isaka ..... G10F 5/00 84/94.1
2004/0123718 A1 * 7/2004 Muramatsu ..... G10F 1/06 84/94.1
2015/0000498 A1 * 1/2015 Uekihara ..... G10F 1/06 84/97

* cited by examiner

*Primary Examiner* — Robert W Horn

(57) ABSTRACT

A music box structure with composing function comprises primarily a comb reed composed of teeth which are tuned to play various musical notes, a motor-driven cylinder, and a plurality of pins, wherein on a surface of the cylinder are disposed a plurality of spaced jack holes corresponding to the teeth of the comb reed. When in use, a user may insert pins into various jack holes on the cylinder according to various music scores or the user's own composition with the inserted pins having an appropriate protrusion height. When the cylinder is driven to rotate by the motor, the inserted pins pluck the teeth at various positions on the comb reed in order and produce music.

1 Claim, 5 Drawing Sheets

MUSIC BOX STRUCTURE WITH COMPOSING FUNCTION

BACKGROUND OF THE INVENTION

1. Field of the Invention

The present invention relates to a music box structure with composing function, and particularly to a music box structure with composing function that may play music according to various music scores or a user's own composition.

2. Description of Related Art

A conventional music box structure usually comprises a base body thereon are disposed a comb reed with teeth and a cylinder on a surface thereof are disposed projections corresponding to the teeth tuned to play various musical notes so that when the cylinder is rotated by a spring the projections at various positions on the cylinder may pluck the teeth at various positions on the comb reed to produce music. The conventional music box has the disadvantage of having fixed projections on a surface of the cylinder and may only play preset music allowing no variation.

In view of this, after laborious research and experiments, the applicant has devised a music box structure with composing function that may play music according to various music scores or a user's own composition.

SUMMARY OF THE INVENTION

It is a primary objective of the present invention to provide a music box structure with composing function that may play music according to various music scores or a user's own composition.

A foregoing music box structure with composing function comprises a comb reed composed of teeth tuned to play various musical notes, a motor-driven cylinder, and a plurality of pins, wherein on a surface of the cylinder are disposed a plurality of spaced jack holes corresponding to the teeth of the comb reed. When in use, a user may insert pins into various jack holes on the cylinder according to various music scores or the user's own composition with the inserted pins having an appropriate protrusion height. When the cylinder is driven to rotate by the motor, the inserted pins pluck the teeth at various positions on the comb reed in order and produce music.

A foregoing music box structure with composing function, wherein the comb reed and the motor-driven cylinder are disposed on a base body.

A foregoing music box structure with composing function, wherein on the base body is disposed a storage box for storing pins.

A foregoing music box structure with composing function, wherein the motor is connected to a setup key protruding from the base body for controlling the cylinder to rotate at intervals to facilitate the insertion of pins.

A foregoing music box structure with composing function, wherein on the base body is disposed a liftable upper cover for providing dust-proof effect and facilitating the portability and storage of the music box structure with composing function.

DETAILED DESCRIPTION OF THE PREFERRED EMBODIMENTS

Figure 1:
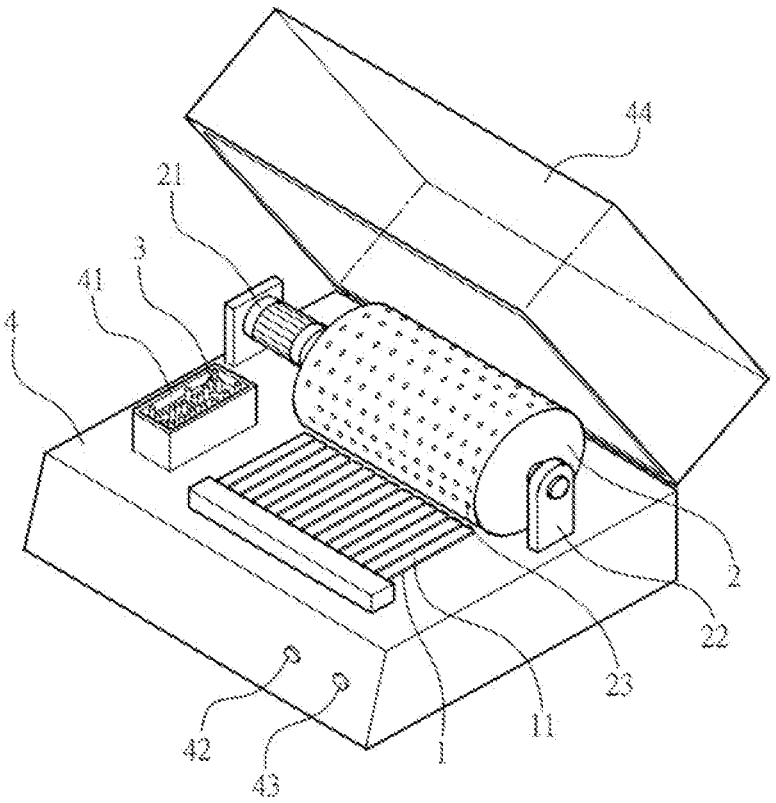
FIG. 1 is a three-dimensional view of the present invention.

Please refer to FIG. 1, showing a three-dimensional view of the present invention. As the figure shows, the present invention includes a comb reed 1, a cylinder 2 driven by a motor 21, and a plurality of pins 3. On the comb reed 1 are disposed a plurality of teeth 11 that are tuned to play various musical notes when being plucked. The cylinder 2 is disposed on a frame body 22, wherein one end of the cylinder 2 protrudes from the frame body 22 and is pivotally connected to the motor 21 to be driven by the motor 21 to rotate at an appropriate speed. On a surface of the cylinder 2 are disposed a plurality of spaced jack holes 23 corresponding to the teeth 11 of the comb reed 1. Each of the jack holes 23 on every row represents a musical note (Do, Re, Mi, etc.); a melody may be formed with the combination of the musical notes on all the rows.

In the present embodiment, the foregoing comb reed 1, the cylinder 2, and the frame body 22 that supports the cylinder 2 are disposed on a base body 4. At an appropriate position on the base body 4 is disposed a storage box 41 for storing a plurality of pins 3. On the base body 4 are also disposed a setup key 42 that is connected to the motor 21 and protrudes from the base body 4 as well as a startup key 43 for controlling respectively the rotation at intervals and activation of the motor 21. In the present embodiment, on the base body 4 may be disposed an upper cover 44 that may be opened or closed along the base body 4 for covering the top of the base body 4.

The foregoing components are combined to form a music box structure with composing function. When in use, a user may insert pins 23 respectively into various jack holes 23 on the cylinder 2 according to various music scores or the user's own composition with the inserted pins having an appropriate protrusion height. When the cylinder 2 is driven to rotate by the motor 21, the inserted pins 23 pluck the teeth 11 at various positions on the comb reed 1 in order and produce music.

Figure 2:
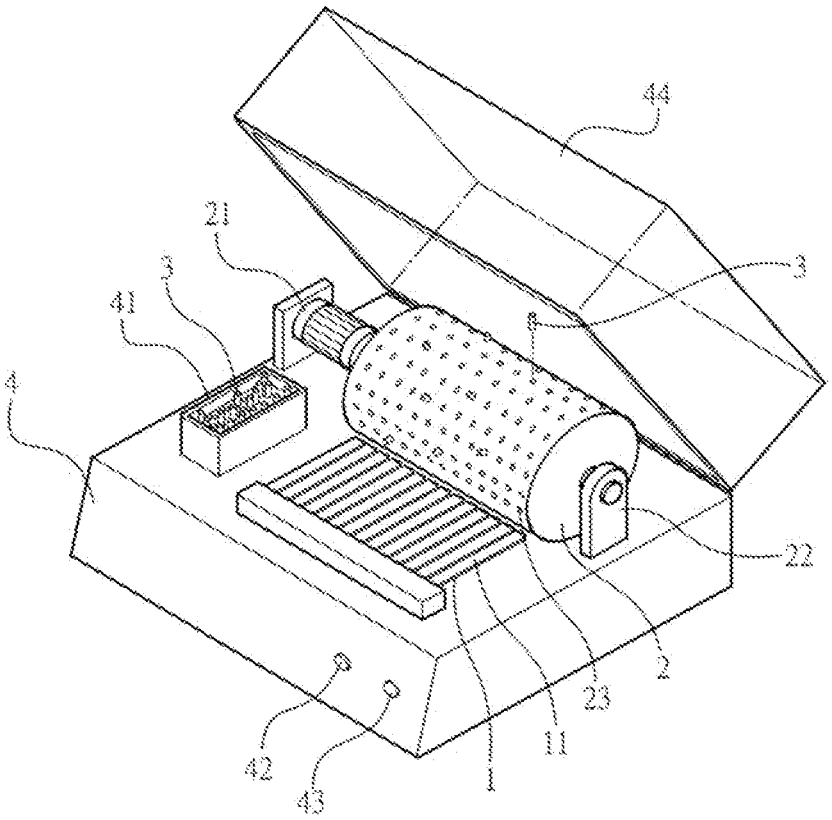
FIG. 2 is a drawing of the present invention showing the setting up of pins.

Please refer to FIG. 2, which is a drawing of the present invention showing the setting up of pins. As the figure shows, when the present invention is in use, the setup key 42 is pushed to make the motor 21 rotate at intervals. Each rotation moves at a distance of a row of jack holes 23 on the cylinder 2 or an appropriate width to expose an appropriate range for inserting pins 3 into various jack holes 23 on the cylinder 2 according to various music scores or the user's own composition with the inserted pins 3 having an appropriate protrusion height.

Figure 3:
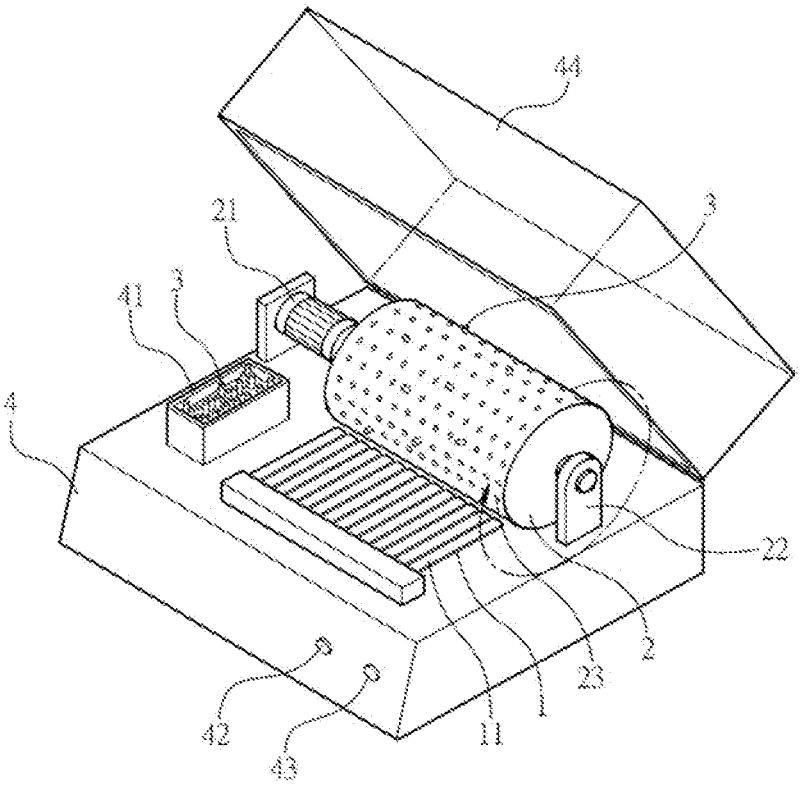
FIG. 3 is a drawing of the present invention in operation.

Please refer to FIG. 3, showing a drawing of the present invention in operation. As the figure shows, after the foregoing setting up is done, the motor 21 may be driven by the startup key 43 to drive the cylinder 2 to rotate at an appropriate speed. During the rotation of the cylinder 2, the pins 3 disposed on the surface of the cylinder 2 pluck teeth 11 at various positions on the comb reed 1 and play music according to various music scores or a user's own composition.

Figure 4:
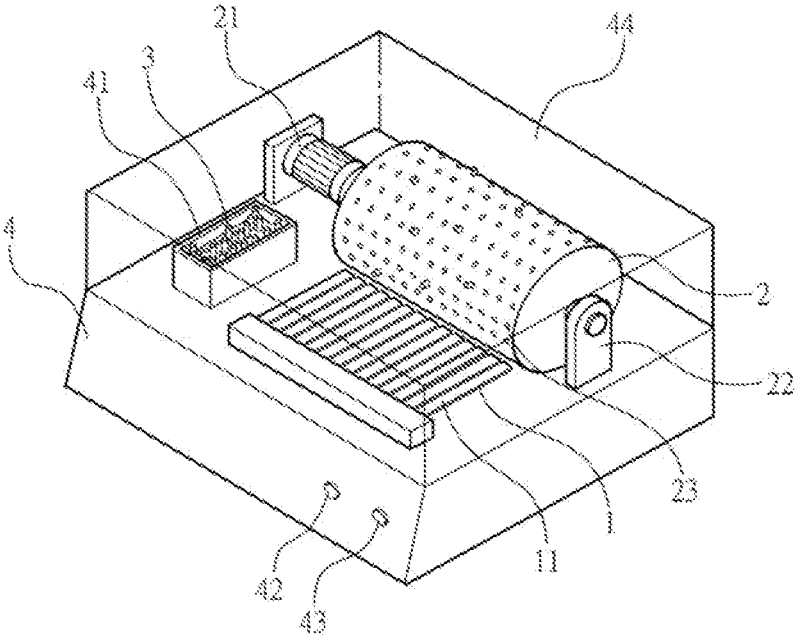
FIG. 4 is a drawing of the present invention when being stowed.

Please refer to FIG. 4, showing a drawing of the present invention when being stowed. As the figure shows, when the present invention is being stowed, the upper cover 44 disposed on the base body 4 may be closed for providing dust-proof effect and protecting the comb reed 1, the cylinder 2, the motor 21, and the pins 3 from dust or foreign matters and for facilitating the portability and storage of the music box structure with composing function.

Figure 5:
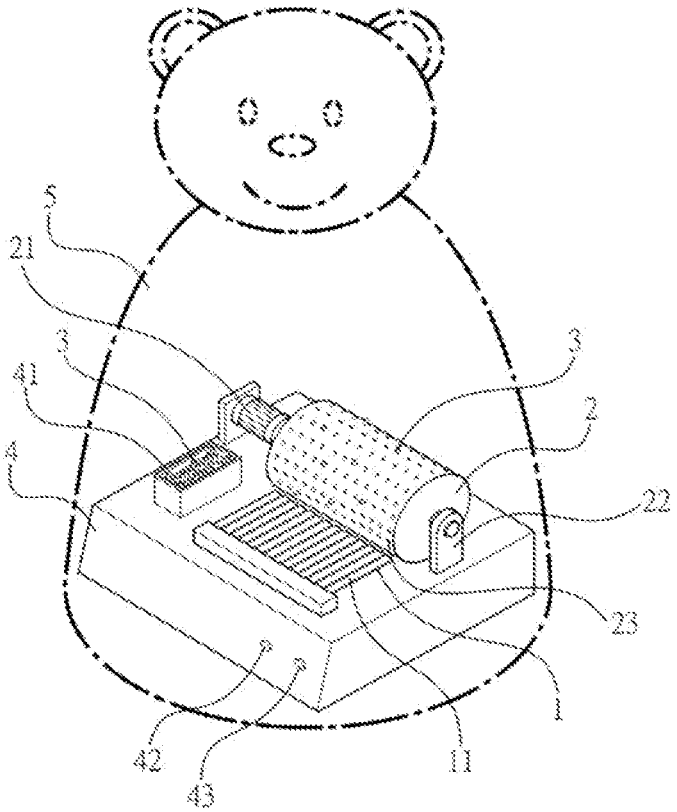
FIG. 5 is a three-dimensional drawing of the present invention applied to a stuffed animal.

Please refer to FIG. 5, showing a three-dimensional drawing of the present invention applied to a stuffed animal. As the figure shows, besides having the advantage of allowing free composition, the present invention may also be used in combination with other objects. As the present embodiment shows, the base body 4 may be placed in a stuffed animal 5 for allowing the stuffed animal 5 to play music according to various music scores or a user's own composition.

The foregoing preferred embodiments of the present invention are illustrated of the present invention rather than limiting of the present invention. They are intended to cover various modifications and changes included within the spirit and scope of the appended claims, the scope of which should be accorded the broadest interpretation so as to encompass all such modifications and similar structures.

In view of the foregoing considerations, the present invention relates to a music box structure with composing function comprising a comb reed, a cylinder with jack holes, and a plurality of pins to be inserted into jack holes at various positions on the cylinder for playing music according to various music scores or a user's own composition

What is claimed is:

1. A music box structure with composing function, comprising:

a comb reed composed of teeth which are tuned to play various musical notes;

a cylinder pivotally connected to a motor, on a surface thereof are disposed a plurality of spaced jack holes corresponding to the teeth of the comb reed;

a plurality of pins to be inserted in the plurality of jack holes on the cylinder;

wherein the comb reed, the motor, and the cylinder are disposed on a base body; on the base body is disposed a liftable upper cover for providing dust-proof effect and facilitating the portability and storage of the music box structure with composing function;

wherein the motor is connected to a setup key for controlling the cylinder to rotate at intervals to facilitate the insertion of pins, when in use, pins are inserted into various jack holes on the cylinder according to various music scores or a user's own composition with the inserted pins having an appropriate protrusion height; and when the cylinder is driven to rotate by the motor, the inserted pins pluck the teeth at various positions on the comb reed in order and produce music.

* * * * *